US006296719B1

(12) United States Patent
Fortunati et al.

(10) Patent No.: US 6,296,719 B1
(45) Date of Patent: Oct. 2, 2001

(54) PROCESS FOR THE PRODUCTION OF GRAIN ORIENTED ELECTRICAL STEEL STRIP HAVING HIGH MAGNETIC CHARACTERISTICS, STARTING FROM THIN SLABS

(75) Inventors: Stefano Fortunati, Ardea; Stefano Cicale', Rome; Giuseppe Abbruzzese, Montecastrilli, all of (IT)

(73) Assignee: Acciai Speciali Terni S.p.A., Terni (IT)

( * ) Notice: Subject to any disclaimer, the term of this patent is extended or adjusted under 35 U.S.C. 154(b) by 0 days.

(21) Appl. No.: 09/243,000

(22) PCT Filed: Jul. 21, 1997

(86) PCT No.: PCT/EP97/03921

§ 371 Date: Feb. 26, 1999

§ 102(e) Date: Feb. 26, 1999

(87) PCT Pub. No.: WO98/08987

PCT Pub. Date: Mar. 5, 1998

(30) Foreign Application Priority Data

Aug. 30, 1996 (IT) ..... RM96A0600

(51) Int. Cl.[7] ..... C21D 8/12

(52) U.S. Cl. ..... 148/111; 148/112; 148/307; 148/230; 164/476; 164/477; 164/478

(58) Field of Search ..... 148/307, 111, 148/112, 230, 541; 164/476, 477, 478

(56) References Cited

U.S. PATENT DOCUMENTS 5,507,883 * 4/1996 Tanaka et al. ..... 148/111
5,512,110 * 4/1996 Yoshitomi et al. ..... 148/111
5,711,825 * 1/1998 Bolling et al. ..... 148/111

* cited by examiner

*Primary Examiner*—Deborah Yee
(74) *Attorney, Agent, or Firm*—Hedman & Costigan, P.C.

(57) ABSTRACT

In the production of high permeability electrical steel, the control of condition of thin slab continuous casting allows to obtain advantageous solidification structures and precipitates. This, in turn, allows to decritize the process for controlling the grain dimensions and to add nitrogen to the cold rolled sheet, such as to immediately form aluminum nitride.

11 Claims, No Drawings

PROCESS FOR THE PRODUCTION OF GRAIN ORIENTED ELECTRICAL STEEL STRIP HAVING HIGH MAGNETIC CHARACTERISTICS, STARTING FROM THIN SLABS

This application is a 371 of PCT/EP97/03 921 filed Jul. 21, 1997.

FIELD OF THE INVENTION

The present invention refers to a process for the production of grain oriented electrical steel strip having high magnetic characteristics, starting from thin slabs, and more precisely refers to a process in which the casting conditions are controlled to obtain such microstructural characteristics in the thin slab (high ratio of equiaxic to columnar grains, equiaxic grains dimensions, reduced precipitates dimensions and specific distribution thereof) as to simplify the production process still permitting to obtain excellent magnetic characteristics.

STATE OF THE ART

Grain oriented electrical silicon steel is generically classified into two main categories, essentially differing in relevant induction value measured under the effect of an 800 As/m magnetic field, called B800 value; the conventional grain oriented product has a B800 lower than about 1890 mT, while the high-permeability product has a B800 higher than 1900 mT. Further subdivisions are made considering the core losses value, expressed in W/kg at given induction and frequency. The conventional oriented grain steel sheet was first produced in the '30 ties and still has an important range of utilization; the high-permeability oriented grain steel came in the '60 ties second half and also has many applications, mainly in those fields in which its advantages of high permeability and of lower core losses can compensate for the higher costs with reference to the conventional product.

In the high-permeability electrical sheets, the higher characteristics are obtained utilizing second phases (particularly AlN) which, duly precipitated, reduce the grain boundary mobility and permit the selective growth of those grains (body-centered cubic) having an edge parallel to the rolling direction and a diagonal plane parallel to the sheet surface (Goss structure), with a reduced disorientation with respect to said directions.

However, during the liquid steel solidification the AlN which is responsible for better results, precipitates in coarse form, which will not provide the desired results, and must be dissolved and reprecipitated in the right form which has to be maintained up to the moment when the grain structure is obtained having the desired dimensions and orientation. This is achieved during a final annealing stage, after cold rolling to the final thickness, at the end of a complex and costly transformation process. It was immediately recognized that the production problems, mainly referred to the difficulties in obtaining good yields and uniform quality, were mainly attributable to all of the precautions required to maintain AlN in the necessary form and distribution during the whole steel transformation process.

In this respect, a technology was developed, for instance described in U.S. Pat. No. 4,225,366 and in EP patent 339,474, in which the aluminum nitride apt to control the grain growth process is produced by means of strip nitriding, preferably after cold rolling.

In this technology, the aluminum nitride coarsely precipitated during the slow solidification of the steel is maintained in this state utilizing low slab heating temperatures (lower than 1280° C. preferably lower than 1250° C.) before hot rolling; the nitrogen introduced into the strip after its decarburization immediately reacts forming silicon and manganese/silicon nitrides, which have a relatively low solution temperature and are dissolved during the final box annealing; the thus obtained free nitrogen diffuses through the strip and reacts with aluminum, reprecipitating in fine and homogeneous form along the strip thickness as mixed aluminum/silicon nitride; this process requires maintaining the steel at 700–850° C. for at least four hours.

In the above patents it is stated that the nitriding temperature must be near to the decarburizing one (about 850° C.) and anyhow must not exceed 900° C., to avoid an uncontrolled grain growth, due to the lack of suitable inhibitors. In effect, the best nitriding temperature seems to be of 750° C., the temperature of 850° C. being an upper limit to avoid uncontrolled grain growth.

This process seems to comprise some advantages, such as the relatively low temperatures of slab heating before hot rolling, of decarburization and of nitriding, and the fact that the need to keep the strip at 700–850° C. for at least four hours in the box-annealing furnace (to obtain mixed aluminum/silicon nitrides necessary for the grain growth control) does not add to the over-all production costs, in that the heating of the box annealing furnace in any case requires similar time.

However, the above only seem to be advantages. in that: (i) the low slab heating temperature keeps the coarse form of the aluminum nitride precipitates, unable to control the grain growth process, hence all the subsequent heatings, particularly in the decarburization and nitriding processes, must take place at relatively low, carefully controlled temperatures, precisely to avoid uncontrolled grain growth; (ii) the treating times at such low temperatures must be consequently prolonged; (iii) it is impossible to introduce, in the final annealings, possible improvements to speed-up the heating time, for instance utilizing continuous furnaces instead of the discontinuous ones of box annealing.

DESCRIPTION OF THE INVENTION

The present invention is intended to obviate to the drawbacks of known production processes, opportunely utilizing the thin slab continuous casting process, to obtain thin silicon steel slabs having specific solidification and microstructural characteristics, permitting to obtain a transformation process free of a number of critical steps. In particular, the continuous casting process is conducted so as to obtain in the slabs a given ratio of equiaxic to columnar grains, specific dimensions of equiaxic grains and fine precipitates.

The present invention refers to a production process of high magnetic characteristics silicon steel strip, in which a steel containing, in weight percent, 2.5–5 Si, 0.002–0.075 C, 0.05–0.4 Mn, S (or S+0.504 Se)<0.015, 0.010–0.045 Al, 0.003–0.0130 N, up to 0.2 Sn, 0.040–0.3 Cu, remaining being iron and minor impurities, is continuously cast, high-temperature annealed, hot rolled, cold rolled in a single step or in a plurality of steps with intermediate annealings, the cold rolled strip so obtained is annealed to perform primary annealing and decarburization, coated with annealing separator and box annealed for the final secondary recrystallization treatment, said process being characterized by the combination in cooperation relationship of:

(i) continuously casting a thin slab having a thickness of between 20 and 80 mm, preferably of between 50 and 60 mm, with a casting speed of 3 to 5 m/min, a steel overheating at the casting of between 20 and 40° C., such a cooling speed as to obtain a complete solidification within 30 to 100 s, a mould oscillation amplitude of between 1 and 10 mm, and an oscillation frequency of between 200 and 400 cycles per minute;

(ii) equalizing the thus obtained slabs at a temperature comprised between 1150 and 1300° C.;

(iii) hot rolling the equalized slabs with a starting rolling temperature of between 1000 and 1200° C. and a finishing rolling temperature of between 850 and 1050° C.;

(iv) continuously annealing the hot rolled strips for 30 to 300 at a temperature of between 900 and 1170° C., cooling the same at a temperature no lesser than 850° C. and maintaining said temperature for 30 to 300 s, and then cooling them, possibly in boiling water;

(v) cold rolling the strip in a single step or in a plurality of steps with intermediate annealings, the last step being performed with a reduction ratio of at least 80%, maintaining a rolling temperature of at least 200° C. in at least two rolling passes during the last step;

(vi) continuously annealing the cold rolled strip for a total time of 100 to 350 s, at a temperature comprised between 850 and 1050° C. in a wet nitrogen/hydrogen atmosphere, with a $pH_2O/pH_2$ comprised between 0.3 and 0.7;

(vii) coating the strip with annealing separator, coiling it and box annealing the coils in an atmosphere having the following compositions during the heating-up: hydrogen mixed with at least 30% vol nitrogen up to 900° C., hydrogen mixed with at least 40% vol nitrogen up to 1100–1200° C., then maintaining the coils at this temperature in pure hydrogen.

The steel composition can be different from the conventional one, in that very low carbon contents can be contemplated, between 20 and 100 ppm.

There can be also a copper content of between 400 and 3000 ppm, preferably between 700 and 2000 ppm.

It is also possible to have a tin content up to 2000 ppm, preferably between 1000 and 1700 ppm.

During the continuous casting, the casting parameters are chosen to obtain an equiaxic to columnar grains ratio comprised between 35 and 75%, preferably higher than 50%, equaxic grain dimensions preferably comprised between 0.7 and 2.5 mm; thanks to the rapid cooling during this thin slab continuous casting, the second phases (precipitates) have sensibly lesser dimensions with respect to those obtained during the traditional continuous casting.

If during the decarburization annealing the temperature is kept below 950° C., the nitrogen content in the atmosphere of the following box annealing is controlled to obtain strip nitriding, to directly produce aluminum and silicon nitride in such dimensions, quantity and distribution to permit an efficient grain growth inibition during the subsequent secondary recrystallization. The nitrogen maximum amount to be introduced in this case is less than 50 ppm.

After the decarburization annealing, it is possible to utilize a further continuous passage consisting in keeping the strip at a temperature of between 900 and 1050° C., preferably over 1000° C., in a nitriding atmosphere, to permit a nitrogen absorption up to 50 ppm, to obtain the formation of fine aluminum nitride precipitates, distributed through the thickness of the strip.

In this case, water vapour must be present in a quantity comprised between 0.5 and 100 $g/m^3$.

If tin is present in the steel, atmospheres with a higher nitriding potential should be utilized (for instance containing $NH_3$), since tin inhibits nitrogen absorption.

The above steps of the process can be interpreted as follows. The thin slab continuous casting conditions are selected to obtain a number of equiaxial grains higher than the one (usually around 25%) obtainable in the traditional continuous casting (slab thickness around 200–250 mm) as well as crystals dimensions and fine precipitates distribution particularly apt to the obtention of a high-quality end product. In particular, the precipitates fine dimensions and the following thin slab annealing at a temperature up to 1300° C. allow to obtain already in the hot-rolled strip aluminum nitride precipitates apt to somewhat control the grain dimensions, thus permitting to avoid a strict control of the maximum treating temperatures and to utilize shorter treating times, in view of said higher temperatures.

In this same sense must be considered the possibility to utilize very low carbon contents, preferably lower than the ones necessary to form a gamma phase, to limit the dissolution of aluminum nitride, much less soluble in the alpha phase than in the gamma one.

The cited presence, since the slab formation, of an even small quantity of fine aluminum nitride precipitates allows to decriticize the thermal treatments, also permitting to rise the decarburization temperature without risk of an uncontrolled grain growth; this raised temperature is essential to permit a better nitrogen diffusion throughout the strip and the formation, directly in this step, of further aluminum nitride. In such conditions, moreover, there is necessity just a limited nitrogen amount to be diffused into the strip.

With respect to the nitriding step, the choice of its conditions do not seem to be particularly important; nitriding can be performed during the decarburization annealing, in which case it is interesting to keep the treating temperature at around 1000° C. to directly obtain aluminum nitride. If, on the contrary, the decarburization temperature is kept low, most of the nitrogen absorption will take place during the box annealing.

EXAMPLES

The process according to the present invention will now be illustrated by the following Examples which are not intended to limit the invention.

Example 1

The following steels were produced, whose composition is in Table 1

TABLE 1

| Type | Si % | C ppm | Mn % | Cu % | S ppm | $Al_s$ ppm | N ppm | Sn ppm |
|---|---|---|---|---|---|---|---|---|
| A | 3.15 | 500 | 0.10 | 0.10 | 70 | 270 | 80 | 150 |
| B | 3.22 | 450 | 0.12 | 0.12 | 80 | 290 | 83 | 150 |
| C | 3.05 | 480 | 0.12 | 0.12 | 70 | 250 | 75 | 1100 |
| D | 3.20 | 100 | 0.14 | 0.13 | 70 | 270 | 81 | 130 |
| E | 3.15 | 20 | 0.12 | 0.12 | 80 | 300 | 40 | 1600 |
| F | 3.20 | 450 | 0.10 | 0.10 | 280 | 270 | 82 | 120 |
| G | 3.30 | 550 | 0.15 | 0.15 | 100 | 80 | 70 | 130 |

The above steels were continuously cast in slabs 60 mm thick. with a casting speed of 4.3 m/min. a solidification time of 65 s, an overheating temperature of 28° C., utilizing a mould oscillating at 260 cycles/min, with a 3 mm oscillation amplitude.

The slabs were equalized at 1180° C. for 10 min and then hot rolled at different thicknesses between 2.05 and 2.15 mm; the strips were then continuously annealed at 1100° C. for 30 s, cooled at 930° C. kept at this temperature for 90 s and then cooled in boiling water.

The strips were cold rolled in a single step at 0.29 mm. utilizing a rolling temperature of 230° C. at the third and fourth rolling pass. Part of the cold rolled strips, called NS, of each composition underwent a primary recrystallization and decarburation according to the following cycle: 860° C. for 180 s in a $H_2$—$N_2$ (75:25) atmosphere with a $pH_2O/pH_2$ of 0.65, then 890° C. for 30 s in a $H_2$—$N_2$ (75:25) atmosphere with a $pH_2O/pH_2$ of 0.02.

For the remaining strips, called ND, the higher treating temperature was 980° C., introducing into the furnace also $NH_3$ to obtain the immediate formation of aluminum nitride. The following Table 2 shows the nitrogen quantities introduced into the strips, according to the $NH_3$ quantity introduced into the furnace.

TABLE 2

| Type | ND1, $NH_3$ 5% | ND2, $NH_3$ 10% | ND3, $NH_3$ 15% |
|---|---|---|---|
| A | 70 | 130 | 220 |
| B | 90 | 150 | 270 |
| C | 30 | 60 | 100 |
| D | 50 | 90 | 130 |
| E | 20 | 50 | 90 |
| F | 40 | 90 | 110 |
| G | 100 | 190 | 340 |

The treated strips were coated with a MgO based conventional annealing separators and box-annealed according to the following cycle: quick heating up to 700° C., holding this temperature for 5 hours, heating up to 1200° C. in a $H_2$—$N_2$ (60–40) atmosphere, holding this temperature for 20 hours in $H_2$.

After the usual final treatments, the following magnetic characteristics were measured:

TABLE 3

| | B800 (mT) | | | | P17 (w/kg) | | | |
|---|---|---|---|---|---|---|---|---|
| Type | NS | ND1 | ND2 | ND3 | NS | ND1 | ND2 | ND3 |
| A | 1930 | 1920 | 1890 | 1850 | 0.95 | 0.98 | 1.09 | 1.19 |
| B | 1920 | 1910 | 1880 | 1840 | 0.97 | 0.98 | 1.10 | 1.28 |
| C | 1930 | 1930 | 1890 | 1880 | 0.88 | 0.90 | 1.02 | 1.07 |
| D | 1920 | 1910 | 1890 | 1890 | 0.89 | 0.97 | 1.07 | 1.12 |
| E | 1930 | 1930 | 1910 | 1890 | 0.85 | 0.88 | 0.95 | 1.05 |
| F | 1570 | 1563 | 1659 | 1730 | 2.53 | 2.47 | 1.98 | 1.79 |
| G | 1620 | 1710 | 1820 | 1940 | 1.29 | 1.72 | 1.42 | 1.35 |

Example 2

Steels of similar compositions, shown in Table 4, were cast utilizing different casting procedures.

TABLE 4

| Type | Si % | C ppm | Mn % | Cu % | S ppm | $Al_s$ ppm | N ppm | Sn ppm |
|---|---|---|---|---|---|---|---|---|
| A1 | 3.20 | 350 | 0.10 | 0.09 | 90 | 290 | 80 | 0.10 |
| B1 | 3.20 | 380 | 0.10 | 0.10 | 80 | 300 | 83 | 0.11 |
| C1 | 3.22 | 330 | 0.11 | 0.10 | 90 | 290 | 75 | 0.10 |

Steel A1 was continuously cast with a slab thickness of 240 mm, obtaining an equiaxic to columnar grains ratio (REX) of 25%.

Steel B1 was continuously cast with a slab thickness of 50 mm, with a REX of 50%.

Steel C1 was continuously cast in thin slabs 60 mm thick, with a REX of 30%.

The slabs were heated at 1250° C., hot rolled at a 2.1 mm thickness, and the strips were annealed as in Example 1, then cold rolled to 0.29 mm.

The cold rolled strips were divided into three groups, each treated according to the following cycles:

Cycle 1: heating at 850° C. for 120 s in $H_2$—$N_2$ (75:25) with $pH_2O/pH_2$ of 0.55, rising the temperature at 880° C. for 20 s in $H_2$—$N_2$ (75:25) with $pH_2O/pH_2$ of 0.02.

Cycle 2: heating at 860° C. for 120 s in $H_2$—$N_2$ (75:25) with $pH_2O/pH_2$ of 0.55, rising the temperature at 890° C. for 20 s in $H_2$—$N_2$ (75:25) with 3% $NH_3$ and $pH_2O/pH_2$ of 0.02.

Cycle 3: heating at 860° C. for 120 s in $H_2$—$N_2$ (75:25) with $pH_2O/pH_2$ of 0.55, rising the temperature at 1000° C. for 20 s in $H_2$—$N_2$ (75:25) with 3% $NH_3$ and $pH_2O/pH_2$ of 0.02.

All the strips were box-annealed as per Example 1. The obtained magnetic characteristics are reported in Table 5.

TABLE 5

| | Cycle 1 | | | Cycle 2 | | | Cycle 3 | | |
|---|---|---|---|---|---|---|---|---|---|
| | A1 | B1 | C1 | A1 | B1 | C1 | A1 | B1 | C1 |
| B800, mT | 1620 | 1940 | 1920 | 1890 | 1940 | 1930 | * | 1950 | 1930 |
| P17, w/kg | 2.17 | 0.89 | 0.95 | 1.08 | 0.85 | 0.89 | * | 0.85 | 0.95 |

*those materials did not reach a satisfactory secondary recrystallization.

Example 3

A steel having the following composition: Si 3.01%, C 450 ppm, Mn 0.09%, Cu 0.10%, S 100 ppm, $Al_s$ 310 ppm, N 70 ppm, Sn 1200 ppm, remaining being iron and minor impurities, was cast in thin slabs as in Example 1 and transformed down to cold rolled strip as in Example 2. The cold rolled strips then underwent different continuous annealing cycles according to the following: Temperature $T_1$ for 180 s in $H_2$—$N_2$ (74:25) with a $pH_2O/pH_2$ of 0.58, temperature $T_2$ for 30 s in $H_2$—$N_2$ (74:25) with different $NH_3$ content and a $pH_2O/pH_2$ of 0.03.

Different $T_1$ and $T_2$ values as well as different $NH_3$ concentrations were utilized and the absorbed nitrogen quantities were measured for each test, the strips were finished according to Example 1 and the magnetic characteristics were measured.

Table 6 shows the obtained B800 values (mT) as a function of absorbed nitrogen, in ppm, with $T_1$=850° C. and $T_2$=900° C.

TABLE 6

| N | 0 | 10 | 25 | 45 | 55 | 100 | 125 | 130 | 150 | 160 | 200 |
|---|---|---|---|---|---|---|---|---|---|---|---|
| B800 | 1935 | 1930 | 1936 | 1930 | 1920 | 1920 | 1910 | 1910 | 1880 | 1890 | 1885 |

Table 7 shows the obtained B800 values as a function of the $T_1$ temperature, $T_2$ being 950° C.

TABLE 7

| $T_1$ ° C. | 830 | 850 | 870 | 890 | 910 | 930 | 950 |
|---|---|---|---|---|---|---|---|
| B800 | 1910 | 1920 | 1935 | 1930 | 1940 | 1945 | 1850 |

Table 8 shows the obtained B800 values as a function of the nitriding temperature $T_2$, $T_1$ being 850° C.

TABLE 8

| $T_2$ ° C. | 800 | 850 | 900 | 950 | 1000 | 1050 | 1100 |
|---|---|---|---|---|---|---|---|
| B800 | 1870 | 1880 | 1910 | 1920 | 1935 | 1925 | 1905 |

What is claimed is:

1. Process for the production of high characteristics silicon steel strip, in which a steel containing in weight percent, 2.5–5 Si, 0.002–0.075 C, 0.05–0.4 Mn, <0.015% S or <0.015% (S+(0.503×Se)), 0.010–0.045 Al, 0.003–0.0130 N, up to 0.2 Sn, 0.040–0.03 Cu, remaining being iron and minor impurities, is continuously cast, high temperature annealed, hot rolled, cold rolled in a single step or in a plurality of steps with intermediate annealing, the cold rolled strip so obtained is annealed to perform primary annealing and decarburization, coated with annealing separator and box annealed to obtain final secondary recrystallization treatment, said process being characterized by the combination in cooperation relationship of:

(i) continuously casting a thin slab having a thickness of between 20 and 80 mm utilizing
  a) a casting speed of 3 to 5 m/min,
  b) a steel temperature during the casting of between 20 and 40° C., higher than the liquids temperature of steel,
  c) such a cooling speed as to obtain a complete solidification within 30 to 100 s,
  d) a mold oscillation amplitude of between 1 and 10 mm, and e) an oscillation frequency of between 200 and 400 cycles per minute;

(ii) equalizing the thus obtained slabs at a temperature comprised between 1150 and 1300° C.;

(iii) hot rolling the equalized slabs with a starting rolling temperature of between 1000 and 1200° C. and a finishing rolling temperature of between 850 and 1050° C.;

(iv) continuously annealing the hot rolled strips for 30 to 300 s at a temperature no less than 850° C. and maintaining said temperature for 30 to 300 s, and then cooling them;

(v) cold rolling the strip in a single step or in a plurality of steps with intermediate annealing, the last step being performed with a reduction ratio of at least 80%;

(vi) continuously treating the cold rolled strip to obtain primary annealing and decarburization for a total time of 100 to 350s, at a temperature comprised between 850 and 1050° C. in a wet nitrogen/hydrogen atmosphere, with a ratio between partial pressures of water vapor and hydrogen according ($pH_2O/pH_2$) comprised between 0.3 and 0.7;

(vii) coating the strip with annealing separator, coiling it and box annealing the coils in an atmosphere having the following compositions during the heating-up: hydrogen mixed with at least 30% vol nitrogen up to 900° C., hydrogen mixed with at least 40% vol nitrogen up to 1100–1200°, then, maintaining the coils at this temperature in pure hydrogen.

2. Process according to claim 1, in which the slab thickness is comprised between 50 and 60 mm.

3. Process according to claim 1, in which the steel carbon content is comprised between 20 and 100 ppm.

4. Process according to claim 1, in which the copper content is between 700 and 2000 ppm.

5. Process according to claim 1, in which the tin content is comprised between 1000 and 1700 ppm.

6. Process according to claim 1, in which during the continuous casting the casting parameters are so chosen as to obtain a number of equiaxed grains to the number of columnar grains of between 35 and 75% with equiaxed grain dimensions comprised between 0.7 and 2.5 mm.

7. Process according to claim 6, in which the number of equiaxed grains to the number of columnar grains is higher than 50%.

8. Process according to claim 1, in which after the cold rolled strip is continuously annealed, a nitriding treatment is performed at a temperature between 900 and 1050° C. in a nitriding atmosphere with a water vapor quantity of between 0.5 and 100 $gm^3$.

9. Process according to claim 1, in which during the decarburization annealing the temperature is kept under 950° C., and the nitrogen content in the atmosphere of the subsequent box-annealing is chosen as to allow the diffusion into the strip of nitrogen up to 50 ppm.

10. Process according to claim 1, in which during the last cold rolling step the strip temperature is maintained at a value of at least 200° C. in at least two rolling passes.

11. Process according to claim 1, wherein in step (iv), cooling is carried out with boiling water.

* * * * *